US011164522B2

(12) United States Patent
Zhang

(10) Patent No.: US 11,164,522 B2
(45) Date of Patent: Nov. 2, 2021

(54) DISPLAY PANEL, BRIGHTNESS COMPENSATION METHOD, AND DISPLAY DEVICE

(71) Applicant: Shanghai Tianma AM-OLED Co., Ltd., Shanghai (CN)

(72) Inventor: Mengmeng Zhang, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 17/134,785

(22) Filed: Dec. 28, 2020

(65) Prior Publication Data

US 2021/0118363 A1 Apr. 22, 2021

(30) Foreign Application Priority Data

Sep. 22, 2020 (CN) ..... 202011004170.9

(51) Int. Cl.
*G09G 3/3233* (2016.01)

(52) U.S. Cl.
CPC ..... *G09G 3/3233* (2013.01); *G09G 2320/029* (2013.01); *G09G 2320/0247* (2013.01)

(58) Field of Classification Search
None
See application file for complete search history.

(56) References Cited

U.S. PATENT DOCUMENTS 10,325,555 B2 * 6/2019 Wu ..... G09G 3/3233
2009/0289919 A1 * 11/2009 Jung ..... G06F 3/0412 345/175
2013/0162620 A1 * 6/2013 Kim ..... G09G 3/3233 345/212
2014/0176402 A1 * 6/2014 Lee ..... G09G 3/32 345/77

FOREIGN PATENT DOCUMENTS

CN 106328051 A 1/2017
CN 107481673 A 12/2017
CN 110910836 A 3/2020

* cited by examiner

*Primary Examiner* — Dorothy Harris
(74) *Attorney, Agent, or Firm* — Tarolli, Sundheim, Covell & Tummino LLP

(57) ABSTRACT

A display panel, a brightness compensation method thereof, and a display device are provided. The display panel includes pixel driving circuits and a voltage detection circuit, the pixel driving circuit includes first to third nodes, the voltage detection circuit includes first to third detection nodes, the first to third detection nodes respectively correspond to and have potentials that are substantially the same as the first to third nodes, and the first node is electrically connected to a gate electrode of a light-emitting driving transistor. The potential of the first detection node reflects the potential of the gate electrode of the light-emitting driving transistor in the pixel driving circuit. Attenuation of brightness of the pixel driving circuit in the low frequency display process can be determined through the voltage detection circuit, thereby compensating for the light-emitting duration of the pixel driving circuit to achieve brightness compensation of the display panel.

16 Claims, 6 Drawing Sheets

DISPLAY PANEL, BRIGHTNESS COMPENSATION METHOD, AND DISPLAY DEVICE

CROSS-REFERENCE TO RELATED APPLICATIONS

The present application claims priority to Chinese Patent Application No. 202011004170.9, filed on Sep. 22, 2020, the content of which is incorporated herein by reference in its entirety.

TECHNICAL FIELD

The present disclosure relates to the field of display technology, and more particularly, to a display panel, a brightness compensation method thereof, and a display device.

BACKGROUND

Light-emitting diode display devices have advantages of low energy consumption, low cost, a wide viewing angle and a fast response speed compared with a traditional liquid crystal display device. Therefore, the light-emitting diode display devices have gradually become the focus technology in the display field, and can be applied to display devices such as mobile phones, televisions, and computers.

The light-emitting diode display device is a current driven display device, therefore, a stable current is required to control light emission thereof. The transistors in the pixel driving circuit used in the existing diode display device are affected by the environment factors such as a high temperature and strong light, and thus are prone to generate leak current. As a result, the current for driving the light-emitting diode display device is unstable, thereby affecting the display effect, and this problem is especially obvious in a low frequency display process.

With reference to FIG. 9, which is a schematic diagram of emission brightness in the related art, the light-emitting diode display device includes a plurality of display periods PT in the display process, and each display period PT includes a plurality of frames of display sub-periods 11/12/13/14, etc. However, the time for writing a data voltage within one display period PT is before a first frame of display sub-period 11, and due to an influence of the current leakage, the light-emitting driving current keeps decaying within one display period PT, thereby causing the emission brightness LM to keep decreasing. Moreover, since the brightness at the end of a previous frame of display period is too low, a problem of flickering occurs when the display period alternates.

SUMMARY

In view of this, the embodiments of the present disclosure provide a display panel, a brightness compensation method thereof, and a display device.

In a first aspect, an embodiment of the present disclosure provides a display panel, including: a plurality of pixel driving circuits, each pixel driving circuit including a light-emitting driving transistor, a first transistor, and a storage capacitor, wherein the light-emitting driving transistor includes a first gate electrode, a first source electrode, and a first drain electrode; the first transistor includes a second gate electrode, a second source electrode, and a second drain electrode; the storage capacitor includes a first electrode plate and a second electrode plate; each of the first gate electrode, the second source electrode, and the second electrode plate is electrically connected to a first node; the second drain electrode is electrically connected to a second node; the first electrode plate is electrically connected to a third node; and the light-emitting driving transistor is configured to generate a light-emitting driving current and output the light-emitting driving current through the first drain electrode in a light-emitting stage; at least one voltage detection circuit, each voltage detection circuit corresponding to at least one pixel driving circuit of the plurality of pixel driving circuits and including a detection capacitor, a first detection transistor, and a detection signal line, wherein the first detection transistor includes a third source electrode and a third drain electrode; the detection capacitor includes a third electrode plate and a fourth electrode plate; the third source electrode, the fourth electrode plate and an end of the detection signal line are electrically connected to a first detection node, the third drain electrode is electrically connected to a second detection node, and the third electrode plate is electrically connected to a third detection node; and a signal processing module, wherein before the light-emitting stage of the plurality of pixel driving circuits starts, a potential of the first detection node of each of the at least one voltage detection circuit is the same as a potential of the first node in each of the at least one pixel driving circuit of the plurality of pixel driving circuits corresponding to the voltage detection circuit; in the light-emitting stage, a potential of the third detection node of the voltage detection circuit is the same as a potential of the third node in each of the at least one pixel driving circuit corresponding to the voltage detection circuit, and a potential of the second detection node of the voltage detection circuit is the same as a potential of the second node in each of the at least one pixel driving circuit corresponding to the voltage detection circuit; and in the light-emitting stage, the third gate electrode controls the first detection transistor to be turned off, and the second gate electrode controls the first transistor to be turned off; and in a detection stage, the detection signal line of the voltage detection circuit outputs the potential of the first detection node to the signal processing module. The first detection transistor and the first transistor are structured the same.

In a second aspect, an embodiment of the present disclosure provides a display device, including the display panel provided in the first aspect.

In a third aspect, an embodiment of the present disclosure provides a brightness compensation method for performing brightness compensation on the display panel provided in the first aspect. A low frequency display process of the display panel includes a plurality of display periods, each of the plurality of display periods includes a data writing stage and N frames of display sub-periods, and the data voltage writing stage is operated before the N frames of display sub-periods; each frame of display sub-period of the N frames of display sub-periods for one row of pixels corresponds to the light-emitting stage of pixel driving circuits of the row of pixels, and the data writing stage for the row of pixels corresponds to a data voltage writing stage of the pixel driving circuits of the row of pixels, where N is a positive integer greater than or equal to 2. The plurality of display periods includes at least one detection display period and at least one compensation display period corresponding to the at least one detection display period, each of the at least one detection display period further includes a detection stage, and the detection stage is operated after the plurality of display sub-periods. The brightness compensation method includes: in the detection stage of each of the at least one detection display period, transmitting, by the detection signal line, the potential of the first detection node to the signal processing module; processing, by the signal processing module, the received potential of the first detection node and a potential of the first detection node in the data writing stage; and determining a duration of each frame of display sub-period of the N frames of display sub-periods during a corresponding one of the at least one compensation display period for each row of pixels according to a processing result.

In the display panel provided in the embodiments of the present disclosure, the voltage detection circuit includes the same transistors, capacitors, and key nodes as the pixel driving circuit. In the voltage detection circuit and in the pixel driving circuit, the corresponding transistors have the same signal, the corresponding capacitors have the same signal, and the corresponding key nodes have the same signal, so that the potential of the first detection node can reflect the potential of the gate electrode of the light-emitting driving transistor in the pixel driving circuit. Attenuation of brightness of the pixel driving circuit in the low frequency display process can be determined through the voltage detection circuit, and thereby the light-emitting duration of the pixel driving circuit can be compensated to achieve brightness compensation of the display panel.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, and other drawings can also be acquired by those skilled in the art without paying creative efforts.

DESCRIPTION OF EMBODIMENTS

For better illustrating technical solutions of the present disclosure, embodiments of the present disclosure will be described in detail below with reference to the accompanying drawings.

It should be noted that, the described embodiments are merely exemplary embodiments of the present disclosure, which shall not be interpreted as providing limitations to the present disclosure. All other embodiments obtained by those skilled in the art without creative efforts according to the embodiments of the present disclosure are within the scope of the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

It should be understood that the term "and/or" used herein is merely an association relationship describing associated objects, indicating that there may be three relationships, for example, A and/or B may indicate that three cases, i.e., A existing alone, A and B existing simultaneously, B existing alone. In addition, the character "/" herein generally indicates that the related objects in front of and at the back of the character form an "or" relationship.

In the description of this specification, it should be understood that the terms "substantially", "basically", "approximately", "about", "almost" and "roughly" described in the claims and embodiments of the present disclosure indicate a value that can be generally agreed within a reasonable process operation range or tolerance range, rather than an exact value.

It should be understood that, although the transistor and node may be described using the terms of "first", "second", "third", etc., in the embodiments of the present disclosure, the transistor and node will not be limited to these terms. These terms are merely used to distinguish transistors and nodes from one another. For example, without departing from the scope of the embodiments of the present disclosure, a first transistor may also be referred to as a second transistor, similarly, a second transistor may also be referred to as a first transistor.

Figure 1:
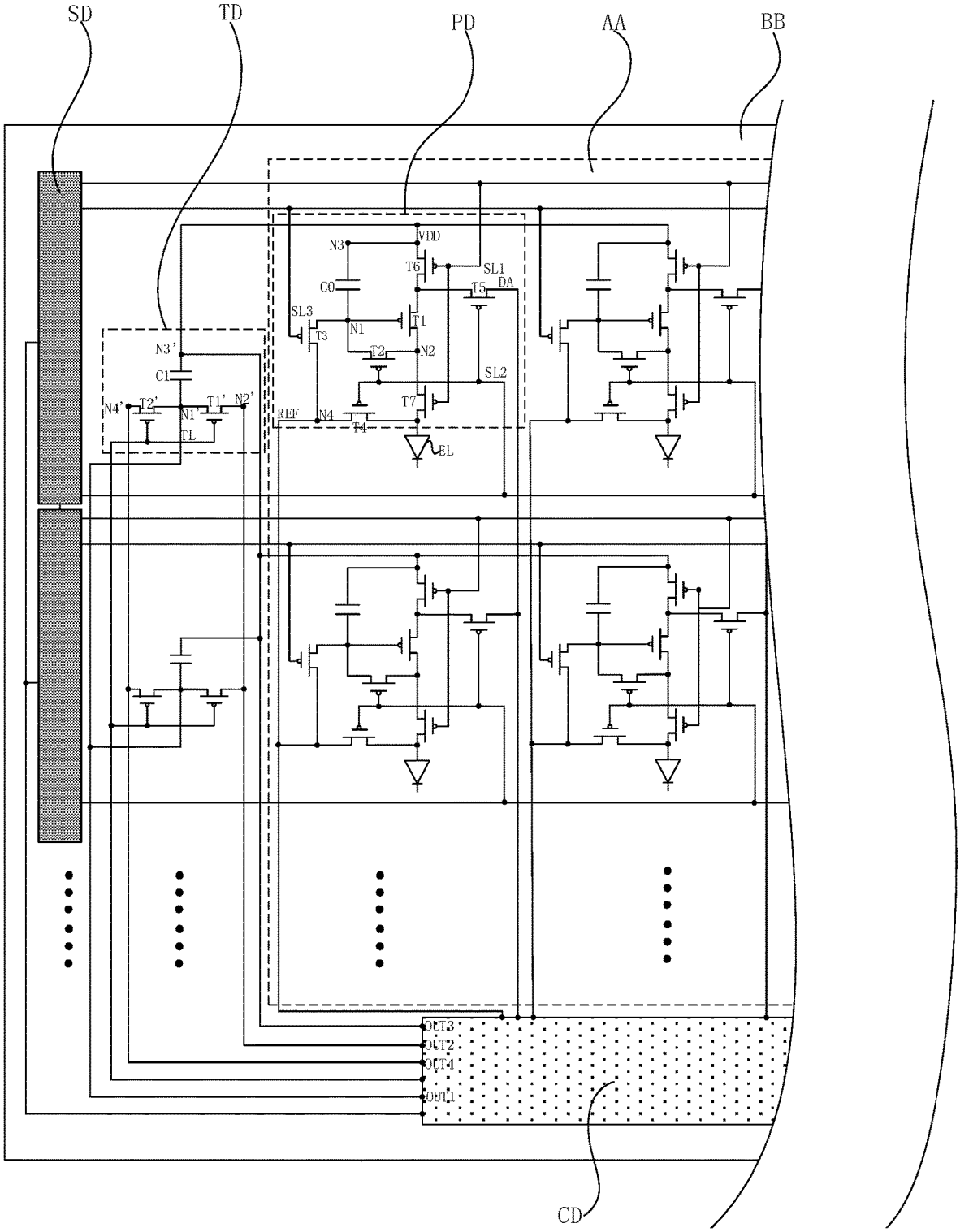
FIG. 1 is a schematic diagram of a display panel according to an embodiment of the present disclosure.
Figure 2:
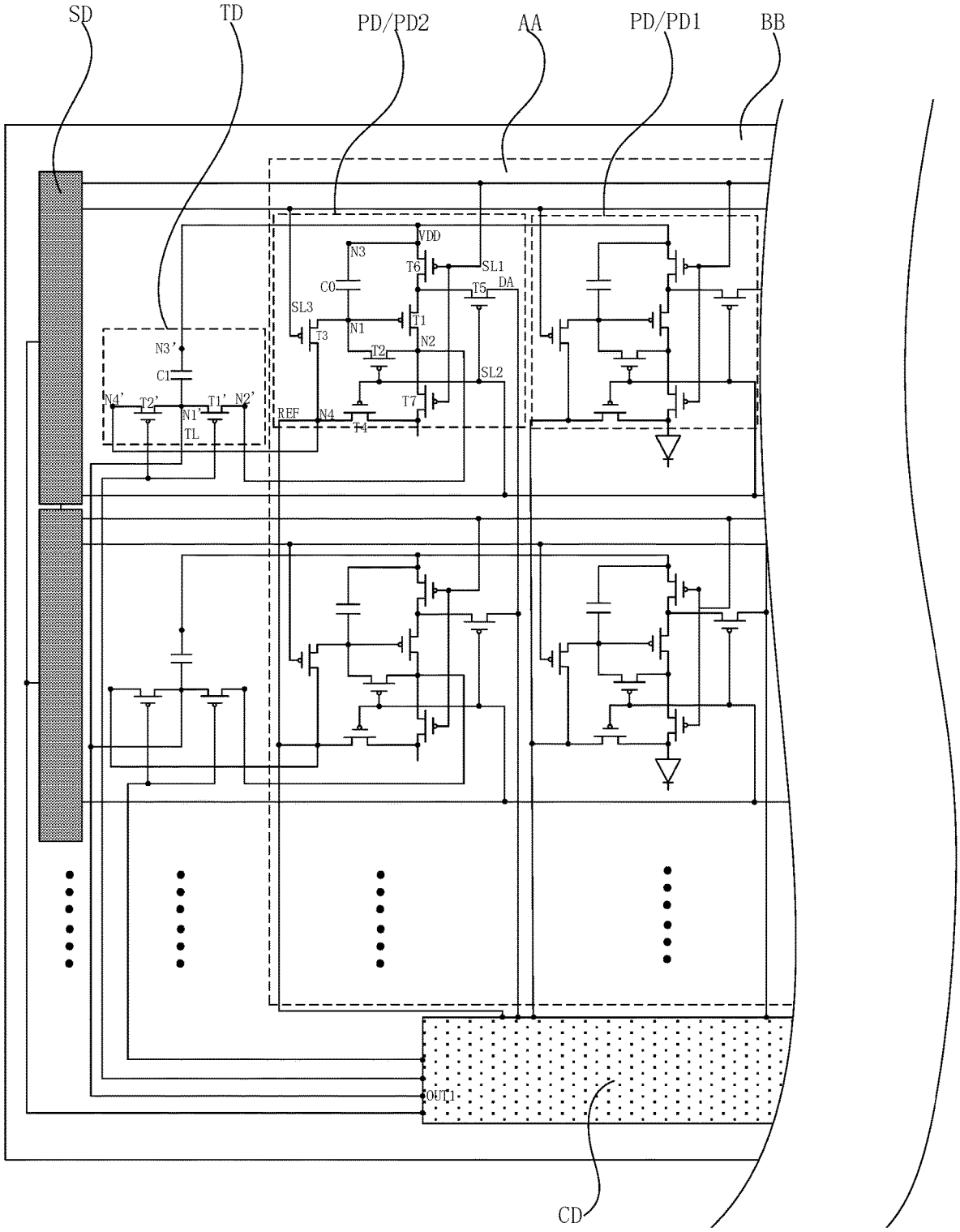
FIG. 2 is a schematic diagram of another display panel according to an embodiment of the present disclosure.

FIG. 1 is a schematic diagram of a display panel according to an embodiment of the present disclosure. FIG. 2 is a schematic diagram of another display panel according to an embodiment of the present disclosure. As shown in FIG. 1 and FIG. 2, an embodiment of the present disclosure provides a display panel, including a plurality of pixel driving circuits PD and at least one voltage detection circuit TD. Here, the at least one voltage detection circuit TD is used to simulate the pixel driving circuits PD, and provides a reference basis for a potential change of a key node in each of the pixel driving circuits PD in a light-emitting stage, in such a manner that the display panel provided in this embodiment of the present disclosure can compensate for the brightness of the pixel driving circuits PD. The pixel driving circuits PD are arranged in a display area AA of the display panel. The at least one voltage detection circuit TD may be arranged in a non-display area BB of the display panel, as shown in FIG. 1 and FIG. 2. Moreover, the at least one voltage detection circuit TD may be alternatively arranged in at least one side region of the display area AA of the display panel, which is close to the non-display area BB.

It should be noted that when the voltage detection circuit TD is only used to detect an influence of the high temperature environment on a potential of a key node in the pixel driving circuit PD, the voltage detection circuit TD can be arranged in the non-display area BB, thereby avoiding an influence on the display area AA. When the voltage detection circuit TD is used to detect an influence of the strong light environment on the potential of the key node in the pixel driving circuit PD, the voltage detection circuit TD can be arranged at an edge of the display area AA. The voltage detection circuit TD can be alternatively arranged in non-display area BB at a position in the non-display area BB that can receive ambient light from a light-exit side of the display panel, for example, an aperture is provided in light-shielding glue to expose the voltage detection circuit TD.

Figure 3:
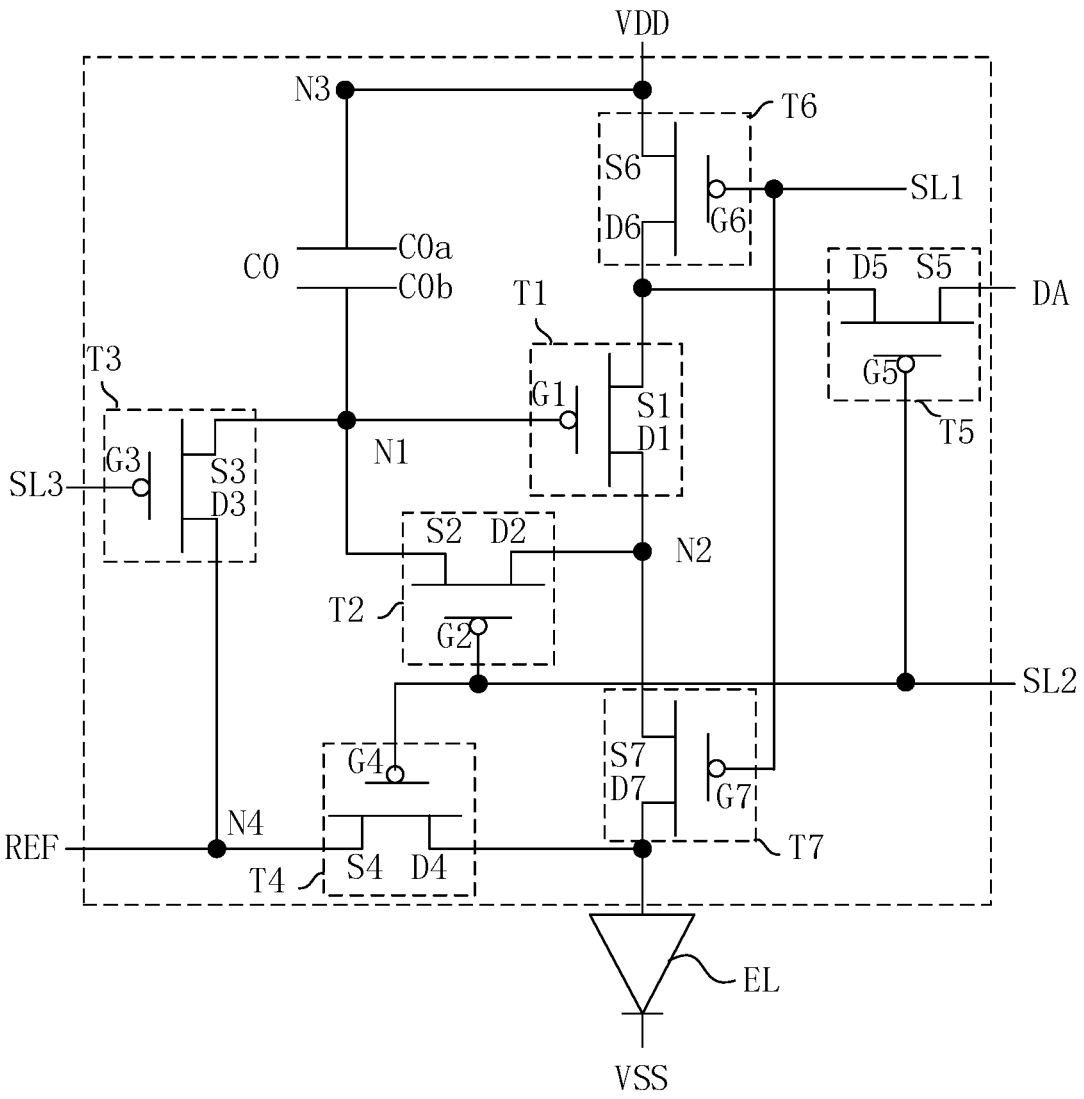
FIG. 3 is a schematic diagram of a pixel according to an embodiment of the present disclosure.
Figure 4:
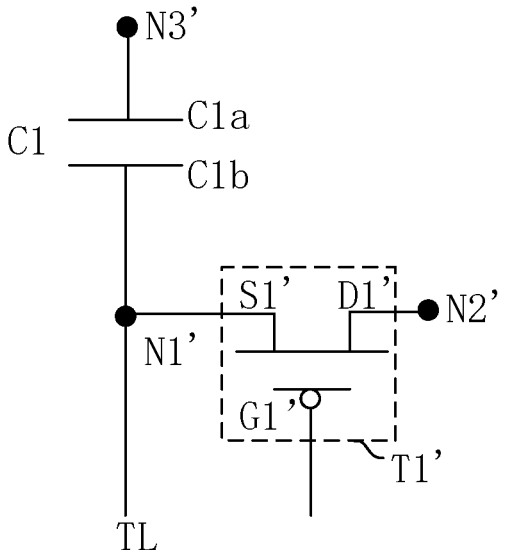
FIG. 4 is an equivalent circuit diagram of a voltage detection circuit according to an embodiment of the present disclosure.

FIG. 3 is a schematic diagram of a pixel according to an embodiment of the present disclosure. FIG. 4 is an equivalent circuit diagram of a voltage detection circuit according to an embodiment of the present disclosure.

As shown in FIG. 3, one pixel includes a pixel driving circuit PD and a light-emitting device EL. The pixel driving circuit PD can provide a driving current or a driving voltage that drives the light-emitting device EL to emit light. The light-emitting device EL is a self-luminous device, such as an organic light-emitting diode, a micro light-emitting diode, etc.

With further reference to FIG. 3, the pixel driving circuit PD includes a light-emitting driving transistor T1, a first transistor T2, and a storage capacitor C0. The light-emitting driving transistor T1 includes a first gate electrode G1, a first source electrode S1, and a first drain electrode D1. The first transistor T2 includes a second gate electrode G2, a second source electrode S2, and a second drain electrode D2. The storage capacitor C0 includes a first electrode plate C0*a* and a second electrode plate C02. The first gate electrode G1, the second source electrode S2, and the second electrode plate C0*b* are electrically connected to a first node N1, the second drain electrode D2 is electrically connected to a second node N2, and the first electrode plate C0*a* is electrically connected to a third node N3.

The light-emitting driving transistor T1 can generate a light-emitting driving current and output the current via the first drain electrode D1 in a light-emitting stage of the pixel driving circuit PD, and a magnitude of the light-emitting driving current is affected by the first gate electrode G1 of the light-emitting driving transistor T1. The second gate electrode G2 controls the first transistor T2 to be turned off in the light-emitting stage, but the first transistor T2 may generate a leak current in the light-emitting stage, thereby affecting a potential of the first gate electrode G1 of the light-emitting driving transistor T1 and thus affecting an emission brightness of the light-emitting device EL.

As shown in FIG. 4, the voltage detection circuit TD includes a detection capacitor C1, a first detection transistor T1' and a detection signal line TL. The detection capacitor C1 includes a third electrode plate C1*a* and a fourth electrode plate C1*b*. The first detection transistor T1' includes a third gate electrode G1', a third source electrode S1', and a third drain electrode D1'. The third source electrode S1', the fourth electrode plate C1*b* and one end of the detection signal line TL are all electrically connected to a first detection node N1', the third drain electrode D1' is electrically connected to a second detection node N2', and the third electrode plate C1*a* is electrically connected to a third detection node N3'.

Before the light-emitting stage of the pixel driving circuit PD starts, a potential of the first detection node N1' in the voltage detection circuit TD is the same as a potential of the first node N1 in at least one pixel driving circuit PD corresponding thereto. In the light-emitting stage, a potential of the third detection node N3' in the voltage detection circuit TD is equal to a potential of the third node N3 in the pixel driving circuit PD corresponding thereto, and a potential of the second detection node N2' is equal to a potential of the second node N2 in the pixel driving circuit PD corresponding thereto.

As shown in FIG. 1 to FIG. 4, the first detection transistor T1' in the voltage detection circuit TD and the first transistor T2 in the pixel driving circuit PD have the same structure. It should be noted that the first detection transistor T1' and the first transistor T2 having the same structure means that within a process error range, the two have exactly the same structure. For example, not only the channels of the first detection transistor T1' and the first transistor T2 are made of the same material, but also a lengths and a width of the channel of the first detection transistor T1' are substantially equal to a length and a width of the channel of the first transistor T2. In the light-emitting stage of the pixel driving circuit PD, the third gate electrode G1' controls the first detection transistor T1' to be turned off, and the second gate electrode G2 controls the first transistor T2 to be turned off.

Since the voltage detection circuit TD and the pixel driving circuit PD are both located in the display panel, then in the light-emitting stage of the pixel driving circuit, the first detection transistor T1' in the voltage detection circuit TD can simulate the first transistor T2 in the pixel driving circuit PD, the detection capacitor C1 can simulate the storage capacitor C0, and the first detection node N1' can simulate the first node N1, that is, the first detection node N1' can simulate the first gate electrode G1 of the light-emitting driving transistor T1 in the pixel driving circuit PD.

As shown in FIG. 1 and FIG. 2, the display panel further includes a signal processing module CD, which may be arranged in the non-display area BB of the display panel. In a detection stage after the light-emitting stage ends, the detection signal line TL transmits the potential of the first detection node N1' to the signal processing module CD, and the signal processing module CD determines whether to compensate for the pixel driving circuit PD, as well as a compensation intensity for the pixel driving circuit PD, by comparing the potential of the first detection node N1' before the light-emitting stage of the pixel driving circuit PD starts with the potential of the first detection node N1' after the light-emitting stage ends. For example, the signal processing module CD determines that the brightness of the display panel needs to be compensated if a difference between the potential of the first node N1' after the light-emitting stage of the pixel driving circuit PD ends and the potential of the first node N1' before the light-emitting stage starts exceeds a preset value, and the greater the difference is, the greater the compensation intensity is.

In an implementation manner of the present disclosure, the second node N2 connected to the second drain electrode D2 of the first transistor T2 in the pixel driving circuit PD may be electrically connected to a data voltage signal line, in order to write a data voltage into the first gate electrode G1 of the light-emitting driving transistor T1 to control the light-emitting driving transistor T1 to generate a light-emitting driving current.

In an implementation manner of the present disclosure, the second node N2 connected to the second drain electrode D2 of the first transistor T2 in the pixel driving circuit PD may be electrically connected to a reset signal line REF, in order to write a reset signal into the gate electrode G1 of the first light-emitting driving transistor T1 to control to reset the light-emitting driving transistor T1.

In an implementation manner of the present disclosure, the second node N2 connected to the second drain electrode D2 of the first transistor T2 in the pixel driving circuit PD may be electrically connected to the first drain electrode D1 of the light-emitting driving transistor T1, in order to acquire a threshold voltage of the light-emitting driving transistor T1.

With further reference to FIG. 3, the pixel driving circuit PD further includes a second transistor T3. The second transistor T3 includes a fourth gate electrode G3, a fourth source electrode S3, and a fourth drain electrode D3. The fourth source electrode S3 is electrically connected to the first node N1, and the fourth drain electrode D3 is electrically connected to a fourth node N4. The fourth gate electrode G3 controls the second transistor T3 to be turned off in the light-emitting stage, but the second transistor T3 may also generate a leak current in the light-emitting stage, thereby affecting the potential of the first gate electrode G1 of the light-emitting driving transistor T1, and thus affecting the emission brightness of the light-emitting device EL.

Figure 5:
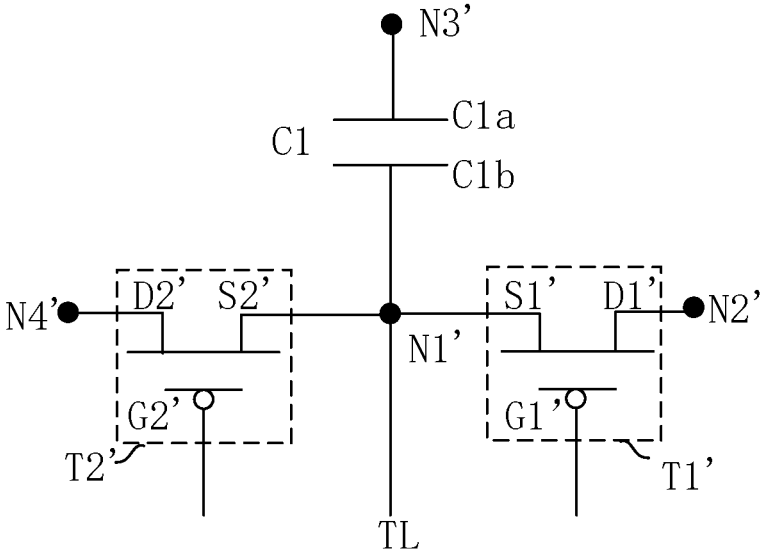
FIG. 5 is an equivalent circuit diagram of another voltage detection circuit according to an embodiment of the present disclosure.

FIG. 5 is an equivalent circuit diagram of another voltage detection circuit according to an embodiment of the present disclosure.

With reference to FIG. 5, the voltage detection circuit TD further includes a second detection transistor T2', and the second detection transistor T2' includes a fifth gate electrode G2', a fifth source electrode S2', and a fifth drain electrode D2'. Here, the fifth source electrode S2' is electrically connected to the first detection node N1', and the fifth drain electrode D2' is electrically connected to a fourth detection node N4'. The fifth gate electrode G2' controls the second detection transistor T2' to be turned off in the light-emitting stage. In the light-emitting stage, a potential of the fourth detection node N4' in the voltage detection circuit TD is the same as a potential of the fourth node N4 in the pixel driving circuit PD corresponding thereto.

As shown in FIGS. 1, 2, 3, and 5, the second detection transistor T2' in the voltage detection circuit TD and the second transistor T3 in the pixel driving circuit PD have the same structure (i.e., they are identical in structure or structured the same). It should be noted that the second detection transistor T2' and the second transistor T3 having the same structure means that within a process error range, the second detection transistor T2' and the second transistor T3 are of exactly the same structure. For example, not only the second detection transistor T2' and the second transistor T3 are made of the same material, but also a length and a width of the channel of the second detection transistor T2' are basically the same as a length and a width of the channel of the second transistor T3. In the light-emitting stage, the fifth gate electrode G2' controls the second detection transistor T2' to be turned off, and the third gate electrode G3 controls the second transistor T3 to be turned off. Then in the light-emitting stage, the second detection transistor T2' in the voltage detection circuit TD can simulate the second transistor T3 in the pixel driving circuit PD.

In other words, when the pixel driving circuit PD includes two transistors that are electrically connected to the first gate electrode G1 of the light-emitting driving transistor T1, the first detection node N1' in the voltage detection circuit TD shall also be electrically connected to two transistors. In this way, the first detection node N1' can simulate the first node N1 in the pixel driving circuit PD, that is, the first detection node N1' can simulate the potential of the first gate electrode G1 of the light-emitting driving transistor T1 in the pixel driving circuit PD.

In an implementation manner of the present disclosure, the fourth node N4 connected to the third drain electrode D3 of the second transistor T3 in the pixel driving circuit PD may be electrically connected to the data voltage signal line, in order to write a data voltage into the first gate electrode G1 of the light-emitting driving transistor T1 to control the light-emitting driving transistor PD to generate a light-emitting driving current.

In an implementation manner of the present disclosure, the fourth node N4 connected to the third drain electrode D3 of the second transistor T3 in the pixel driving circuit PD may be electrically connected to the reset signal line REF, in order to write the reset signal into the first gate electrode G1 of the light-emitting driving transistor T1 to control to reset the light-emitting driving transistor T1.

In an implementation manner of the present disclosure, the fourth node N4 connected to the third drain electrode D3 of the second transistor T3 in the pixel driving circuit PD may be electrically connected to the first drain electrode D1 of the light-emitting driving transistor T1, in order to acquire a threshold voltage of the light-emitting driving transistor T1.

It should be noted that in the pixel driving circuit PD, a signal terminal connected to the second drain electrode D2 of the first transistor T2 is different from a signal terminal connected to the third drain electrode D3 of the second transistor T3, that is, a signal terminal connected to the second node N2 is different from a signal terminal connected to the fourth node N4. For example, the second drain electrode D2 of the first transistor T2 is electrically connected to the first drain electrode D1 of the light-emitting driving transistor T1, and the third drain electrode D3 of the second transistor T3 is electrically connected to the reset signal line.

An operation process of the pixel driving circuit and an operation process of the voltage detection circuit TD corresponding thereto are described below by taking a case where the second node N2 electrically connected to the second drain electrode D2 of the first transistor T2 is electrically connected to the first drain electrode D1 of the light-emitting driving transistor T1, and the fourth node N4 connected to the third drain electrode D3 of the second transistor T3 is electrically connected to the reset signal line REF, as an example.

With reference to FIG. 3, the pixel driving circuit PD further includes a third transistor T4, a fourth transistor T5, a fifth transistor T6, and a sixth transistor T7. The third transistor T4 includes a sixth gate electrode G4, a sixth source electrode S4 and a sixth drain electrode D4. The four transistor T5 includes a seventh gate electrode G5, a seventh source electrode S5, and a seventh drain electrode D5. The fifth transistor T6 includes an eighth gate electrode G6, an eighth source electrode S6, and an eighth drain electrode D6. The sixth transistor T7 includes a ninth gate electrode G7, a ninth source electrode S7, and a ninth drain electrode D7.

The eighth source electrode S6 of the fifth transistor T6 is electrically connected to a first power supply voltage signal line VDD, and the eighth drain electrode D6 is electrically connected to the first source electrode S1 of the light-emitting driving transistor T1. The ninth source electrode S7 of the sixth transistor T7 is electrically connected to the first drain electrode D1 of the light-emitting driving transistor T1, and the ninth drain electrode D7 is electrically connected to an anode or a cathode of the light-emitting device EL. As shown in FIG. 3, the light-emitting device EL may be a light-emitting diode, the ninth drain electrode D7 may be electrically connected to the anode of the light-emitting diode, and the cathode of the light-emitting diode is electrically connected to a second power supply voltage signal line VSS. In the light-emitting stage, the first gate electrode G1 controls the light-emitting driving transistor T1 to be turned on, the eighth gate electrode G6 controls the fifth transistor T6 to be turned on, and the ninth gate electrode G7 controls the sixth transistor T7 to be turned on; then, the light-emitting driving current generated by the light-emitting driving transistor T1 controls the light-emitting device EL to emit light. In the light-emitting stage, the fifth transistor T6 and the sixth transistor T7 are turned on simultaneously, and then the eighth gate electrode G6 of the fifth transistor T6 is electrically connected to both the ninth gate electrode G7 of the sixth transistor T7 and a first scan line SL1. The signal transmitted from the first scan line SL1 to the eighth gate electrode G6 and the ninth gate electrode G7 in the light-emitting stage causes the fifth transistor T6 and the sixth transistor T7 to be turned on.

The sixth source electrode S4 of the third transistor T4 is electrically connected to the fourth node N4, and the sixth drain electrode D4 is electrically connected to the ninth drain electrode D7 of the sixth transistor T7, i.e., electrically connected to the light-emitting device EL. The third transistor T4 can transmit the reset signal on the reset signal line REF electrically connected to the fourth node N4 to the light-emitting device EL to reset the light-emitting device EL.

In addition, the third node N3 may be electrically connected to the first power supply voltage signal line VDD. In a reset stage prior to the light-emitting stage of the pixel driving circuit PD, the third gate electrode G3 controls the second transistor T3 to be turned on, and the reset signal on the reset signal line REF is transmitted to the first gate electrode G1 of the light-emitting driving transistor T1; and due to the presence of the storage capacitor C0, the potential of the first gate electrode G1 of the light-emitting driving transistor T1 is always equal to the potential of the reset signal.

The seventh source electrode S5 of the fourth transistor T5 is electrically connected to the data voltage signal line DA, and the seventh drain electrode D5 is electrically connected to the first source electrode S1 of the light-emitting driving transistor T1. In a data voltage writing stage of the pixel driving circuit PD after the reset stage and before the light-emitting stage, the first transistor T2 and the fourth transistor T5 are turned on, and the data voltage on the data voltage signal line DA is transmitted to the first source electrode S1 of the light-emitting driving transistor T1. Moreover, in an initial stage of the data voltage writing stage, a voltage difference between the first source electrode S1 and the first gate electrode G1 turns on the light-emitting driving transistor T1, and the data voltage is written into the first gate electrode G1 of the light-emitting driving transistor T1. When the potential of the first gate electrode G1 of the light-emitting driving transistor T1 is $(V_{DA}-V_{th})$, the light-emitting driving transistor T1 is turned off, where $V_{DA}$ represents a potential of the data voltage, and $V_{th}$ represents the threshold voltage of the light-emitting driving transistor T1.

In an implementation manner of the present disclosure, the second transistor T3 and the third transistor T4 may be turned on simultaneously during the reset stage to simultaneously reset the light-emitting driving transistor T1 and the light-emitting device EL, respectively.

In another implementation manner of the present disclosure, as shown in FIG. 3, the third transistor T4 may be turned on simultaneously with the first transistor T2 and the fourth transistor T5, then the sixth gate electrode G4 may be electrically connected to the second gate electrode G2 and the seventh gate electrode G5 as well as a second scan line SL2. A signal transmitted from the second scan line SL2 to the second gate electrode G2, the sixth gate electrode G4, and the seventh gate electrode G5 in the data voltage writing stage turns on the first transistor T2, the third transistor T4, and the fourth transistor T5. Meanwhile, the fourth gate electrode G3 of the second transistor T3 is electrically connected to a third scan line SL3, and in the reset stage, a signal transmitted from the third scan line SL3 to the fourth gate electrode G3 turns on the second transistor T3.

It should be noted that the reset stage is first operated and then the data voltage writing stage is operated, prior to the light-emitting stage of the pixel driving circuit PD that generates the light-emitting driving current.

In an embodiment of the present disclosure, in the data voltage writing stage, the first detection node N1' in the voltage detection circuit TD and the first node N1 in the pixel driving circuit PD have substantially the same potential, e.g., a potential corresponding to a data voltage transmitted from the data voltage signal line DA or a potential corresponding to a reset signal transmitted from the reset signal line REF. Moreover, in the data voltage writing stage, the third detection node N3' in the voltage detection circuit TD and the third node N3 in the pixel driving circuit PD have substantially the same potential, e.g., a power supply voltage transmitted from the first power supply voltage signal line VDD. In the light-emitting stage, the second detection node NT in the voltage detection circuit TD receives the same potential as the second node N2 in the pixel driving circuit PD.

When the second node N2 in the pixel driving circuit PD is electrically connected to the reset signal line REF, the potential of the second detection node NT in the voltage detection circuit TD in the light-emitting stage is substantially the same as the potential of the reset signal. When the second node N2 in the pixel driving circuit PD is electrically connected to the data voltage signal line, the potential of the second detection node NT in the voltage detection circuit TD in the light-emitting stage is substantially the same as the potential of the data voltage. When the second node N2 in the pixel driving circuit PD is electrically connected to the first drain electrode D1 of the light-emitting driving transistor T1, the potential of the second detection node N2' in the voltage detection circuit TD is substantially the same as the potential of the first drain electrode D1 of the light-emitting driving transistor T1 in the light-emitting stage.

In addition, in the case where the pixel driving circuit PD includes the second transistor T3 electrically connected to the first gate electrode G1 of the light-emitting driving transistor T1, the voltage detection circuit TD includes the second detection transistor T2'. Moreover, in the data voltage writing stage, the fourth detection node N4' in the voltage detection circuit TD receives the same potential as the fourth node N4 in the pixel driving circuit PD.

When the fourth node N4 in the pixel driving circuit PD is electrically connected to the reset signal line REF, the potential of the fourth detection node N4' in the voltage detection circuit TD in the light-emitting stage is substantially the same as the potential of the reset signal. When the fourth node N4 in the pixel driving circuit PD is electrically connected to the data voltage signal line, the potential of the fourth detection node N4' in the voltage detection circuit TD in the light-emitting stage is substantially the same as the potential of the data voltage. When the fourth node N4 in the pixel driving circuit PD is electrically connected to the first drain electrode D1 of the light-emitting driving transistor T1, the potential of the fourth detection node N4' in the voltage detection circuit TD in the light-emitting stage is substantially the same as the potential of the first drain electrode D1 of the light-emitting driving transistor T1 in the light-emitting stage.

In an implementation manner of an embodiment of the present disclosure, as shown in FIG. 4 and FIG. 5, the potential of the first detection node N1' in the voltage detection circuit TD before the light-emitting stage can be directly written by the detection signal line TL.

In an implementation manner of the embodiment of the present disclosure, as shown in FIG. 4 and FIG. 5, the potential of the first detection node N1' in the voltage detection circuit TD before the light-emitting stage can be written by the first detection transistor T1' that is turned on.

In another implementation manner of the embodiment of the present disclosure, as shown in FIG. 5, the potential of the first detection node N1' in the voltage detection circuit TD before the light-emitting stage can be written by the second detection transistor T2' that is turned on.

In an embodiment of the present disclosure, as shown in FIG. 1, the potential of each detection node in the voltage detection circuit TD is obtained from the signal processing module CD. As shown in FIG. 1, the first detection node N1' in the voltage detection circuit TD may be electrically connected to a first port OUT1 of the signal processing module CD through the detection signal line TL. In the data voltage writing stage of the pixel driving circuit PD, the first port OUT1 can provide the first detection node N1' with a potential which is substantially the same as the potential of the first node N1 in the pixel driving circuit PD; and after the light-emitting stage of the pixel driving circuit PD, the first port OUT1 of the signal processing module CD can acquire the potential of the first detection node N1' through the detection signal line TL.

As shown in FIG. 1 and FIG. 2, the display panel may further include cascaded scan driving circuits SD in the non-display area BB, configured to provide a scan signal for the pixel driving circuits PD. When the potential of each node in the voltage detection circuit TD is directly acquired by the signal processing module CD, the voltage detection circuit TD may be arranged at a side of the scan driving circuits SD away from the display area AA or a side of the scan driving circuits SD close to the display area AA.

The signal processing module CD compares the potential of the first detection node N1' after the light-emitting stage with the potential of the first detection node N1' in the data voltage writing stage to determine whether the pixel driving circuit PD needs to be compensated, as well as the compensation intensity for the pixel driving circuit PD. For example, if the signal processing module CD, after comparison, finds that the potential of the first node N1' after the light-emitting stage differs a lot from the potential of the first detection node N1' in the data voltage writing stage, it determines that there is a need to compensate for the brightness of the display panel, e.g., to appropriately increase a value of the data voltage written into the first gate electrode G1 of the light-emitting driving transistor T1 or to extend the light-emitting time of the pixel driving circuit PD. Moreover, the greater the difference between the potential of the first detection node N1' after the light-emitting stage and the potential of the first detection node N1' in the data voltage writing stage is, the greater the compensation intensity for the pixel driving circuit PD is, for example, further increasing the value of the data voltage written into the first gate electrode G1 of the light-emitting driving transistor T1 or further extending the light-emitting time of the pixel driving circuit PD.

It should be noted that in one frame of displaying, the potentials of the respective nodes in the pixel driving circuits PD are not the same. For example, the respective pixel driving circuits PD in pixels with different display gray levels receive different data voltages, and the potentials of the first nodes N1 in these pixel driving circuits PD are different from one another. Moreover, when the second node N2 electrically connected to the second drain electrode D2 of the first transistor T2 is electrically connected to the first drain electrode D1 of the light-emitting driving transistor T1, the potentials of the second nodes N2 in these pixel driving circuits PD are also different from one another.

In an implementation manner of the present disclosure, the signal processing module CD can select one pixel driving circuit PD as a reference, and provide each node in the voltage detection circuits TD with substantially the same potential as the corresponding node in the pixel driving circuit PD as a reference. For example, if a pixel driving circuit PD at an upper left corner of the display area AA of the display panel shown in FIG. 1 is selected as a reference, then in the data voltage writing stage, the signal processing module CD can provide the first detection node N1' in the voltage detection circuit TD with the same potential as the first node N1 in the pixel driving circuit PD at the upper left corner; and in the light-emitting stage, the signal processing module CD can provide the second detection node N2' in the voltage detection circuit TD with the same potential as the second node N2 in the pixel driving circuit PD at the upper left corner.

In an implementation manner of the present disclosure, the signal processing module CD can pre-store preset potentials to be provided to the respective nodes in the first voltage detection circuits TD, and the preset potential corresponding to each node in the pixel driving circuits PD may be a potential used with the highest frequency by the node, or an average or median value of the potentials frequently used by the node. For example, the preset potential stored in the signal processing module CD and provided to the first detection node N1' in the first voltage detection circuit TD may be a potential used with the highest frequency by the respective first nodes N1 in the respective pixel driving circuits PD during multi-frame displaying, or an average or median value of the potentials used by the respective first nodes N1 in the respective pixel driving circuits PD during multi-frame displaying; the preset potential stored in the signal processing module CD and provided to the second detection node N2' in the first voltage detection circuit TD may be a potential used with the highest frequency by the respective second nodes N2 in the respective pixel driving circuits PD within multi-frame display, or an average or median value of the potentials used by the respective second nodes N2 in the respective pixel driving circuits PD during multi-frame displaying; and the preset potential stored in the signal processing module CD and provided to the third detection node N3' in the first voltage detection circuit TD may be a potential used with the highest frequency by the respective third nodes N3 in the respective pixel driving circuits PD during multi-frame displaying, or an average or median value of the potentials used by the respective third nodes N3 in the respective pixel driving circuits PD during multi-frame displaying.

In an implementation manner of the present disclosure, as shown in FIG. 1, all voltage detection circuits TD are connected in parallel, that is, the first detection nodes N1' in the respective voltage detection circuits TD are electrically connected to each other, the second detection nodes N2' in the respective voltage detection circuits TD are electrically connected to each other, and the third detection nodes N3' in the respective voltage detection circuits TD are electrically connected to each other. As shown in FIG. 1, the same detection nodes in all voltage detection circuits TD are electrically connected to one port of the signal processing module CD, i.e., the first detection nodes N1' in all voltage detection circuits Td are electrically connected to a first port OUT1 of the signal processing module CD, the second detection nodes N2' in all voltage detection circuits TD are electrically connected to a second port OUT2 of the signal processing module CD, the third detection nodes N3' in all voltage detection circuits Td are electrically connected to a third port OUT3 of the signal processing module CD, and the fourth detection nodes N4' in all voltage detection circuits Td are electrically connected to a fourth port OUT4 of the signal processing module CD. In addition, the gate electrodes of the first detection transistor T1' and the second detection transistor T2' can improve the detection stability and accuracy of the voltage detection circuit Td by connecting the voltage detection circuits Td in parallel.

In an embodiment of the present disclosure, as shown in FIG. 2, the plurality of pixel driving circuits PD includes a plurality of first pixel driving circuits PD1 and at least one second pixel driving circuit PD2. Each first pixel driving circuit PD1 is electrically connected to a light-emitting device EL and provides a light-emitting driving current for the light-emitting device EL, and each second pixel driving circuit PD2 is not electrically connected to a light-emitting device EL, that is, the second pixel driving circuit PD2 is a dummy pixel driving circuit PD. As shown in FIG. 2, a circuit structure of the second pixel driving circuit PD2 is the same as a circuit structure of the first pixel driving circuit PD1, and the second pixel driving circuit PD2 can receive a same signal as the first pixel driving circuit PD1 adjacent thereto. With further reference to FIG. 2, the display panel provided by this embodiment of the present disclosure further includes a plurality of scan driving circuits SD that are cascaded, scan lines corresponding to the respective rows of pixel driving circuits PD are provided with a scan signal by different scan driving circuits, respectively, and the first scan line SL1 to the third scan line SL3 in a same row of driving circuits PD is provided with a scan signal by a same scan driving circuit SD, that is, the first scan line SL1 to the third scan line SL3 of each of the second pixel driving circuits PD2 and the first pixel driving circuit PD1 in one row are electrically connected to an output terminal of one scan driving circuit SD. With further reference to FIG. 2, the data voltage signal line DA, the first reference voltage signal line VDD, and the reset signal line REF electrically connected to the second pixel driving circuit PD2 are respectively the same as the data voltage signal line DA, the first reference voltage signal line VDD, and the reset signal line REF electrically connected to the first pixel driving circuit PD1, and can receive a data voltage, a power supply voltage, and a reset signal from the signal processing module CD.

In an implementation manner of the present disclosure, pixel driving circuits PD of each of partial rows/columns include a second pixel driving circuit PD2, and the second pixel driving circuit PD2 is close to the non-display area BB.

In an implementation manner of the present disclosure, pixel driving circuits PD in each of all rows/columns include a second pixel driving circuit PD2, and the second pixel driving circuit PD2 is close to the non-display area BB. As shown in FIG. 2, in each row, a second pixel driving circuit PD2 is provided at a side of the first pixel driving circuit PD1 close to the non-display area BB, and a voltage detection circuit TD is provided at a side of the second pixel driving circuit PD2 close to the non-display area BB and is electrically connected to the second pixel driving circuit PD2.

In an implementation manner of the present disclosure, as shown in FIG. 2, the second detection node N2' and the third detection node N3' in one voltage detection circuit TD may be respectively electrically connected to the second node N2 and the third node N3 in one second pixel driving circuit PD2, and the fourth detection node N4' in the voltage detection circuit TD may be selectively connected to the fourth node N4 in the second pixel driving circuit PD2. The first detection node N1' in the voltage detection circuit TD can be electrically connected to the first node N1 in the corresponding second pixel driving circuit PD2 through a connecting transistor. The first detection node N1' in the voltage detection circuit TD may also be electrically connected to the signal processing module CD through a detection signal line TL to acquire a signal from the signal processing module CD through the detection signal line TL.

In a case where the display panel includes a plurality of second pixel driving circuits PD2 and a plurality of voltage detection circuits TD one-to-one corresponding to plurality of second pixel driving circuits PD2, since the potentials of the same nodes in the second pixel driving circuits PD2 in different rows may be different form one another, then the potentials of the same nodes in the corresponding voltage detection circuits TD may also be different from one another, and thus the potentials of the first detection nodes N1' in different voltage detection circuits TD may also be different from one another. Moreover, the time points at which the same nodes in the second pixel driving circuits PD2 in different rows receive valid potentials are also different from one another. For example, the first node N1, the second node N2, the third node N3, and/or the fourth node N4 in the second pixel driving circuit PD2 in a previous row first receive respective signals, then the first node N1, the second node N2, the third node N3, and/or the fourth node N4 in the second pixel driving circuit PD2 in a next row receive respective signals. Therefore, for the first detection nodes N1' in different voltage detection circuits TD, the time point when receiving the signal is different between the different voltage detection circuits TD and the time point when completing signal simulation is different between the different voltage detection circuits TD. Thus, the potentials of the first detection nodes N1' in different voltage detection circuits TD need to be sequentially transmitted to the signal processing module CD. In an implementation manner, as shown in FIG. 2, the third gate electrodes G1' of the first detection transistors T1' and/or the fifth gate electrodes G2' of the second detection transistors T2' in different voltage detection circuits TD may be connected to different signal lines, and the first detection transistors T1' and/or the second detection transistors T2' in different voltage detection circuits TD are sequentially turned on. In another implementation manner, detection signal lines TL corresponding to different voltage detection circuits TD are electrically connected to different ports of the signal processing module CD.

When the potential of each node in the voltage detection circuit TD is acquired by the corresponding node in the second pixel driving circuit PD2, the accuracy of simulation of the first detection node N1' in the voltage detection circuit TD can be increased, thereby obtaining a better detection result and a better compensation effect without affecting the pixels performing light-emitting and displaying.

As shown in FIG. 2, when the potential of each node in the voltage detection circuit TD is acquired by the corresponding node in the second pixel driving circuit PD2, the voltage detection circuit TD may be arranged at a side of the scan driving circuit SD close to the display area AA and may be adjacent to the corresponding second pixel driving circuit PD2, thereby decreasing difficulty in layout design.

In addition, an embodiment of the present disclosure further provides a brightness compensation method for a display panel, which is used for performing brightness compensation on the display panel provided in any of the above embodiments.

Figure 6:
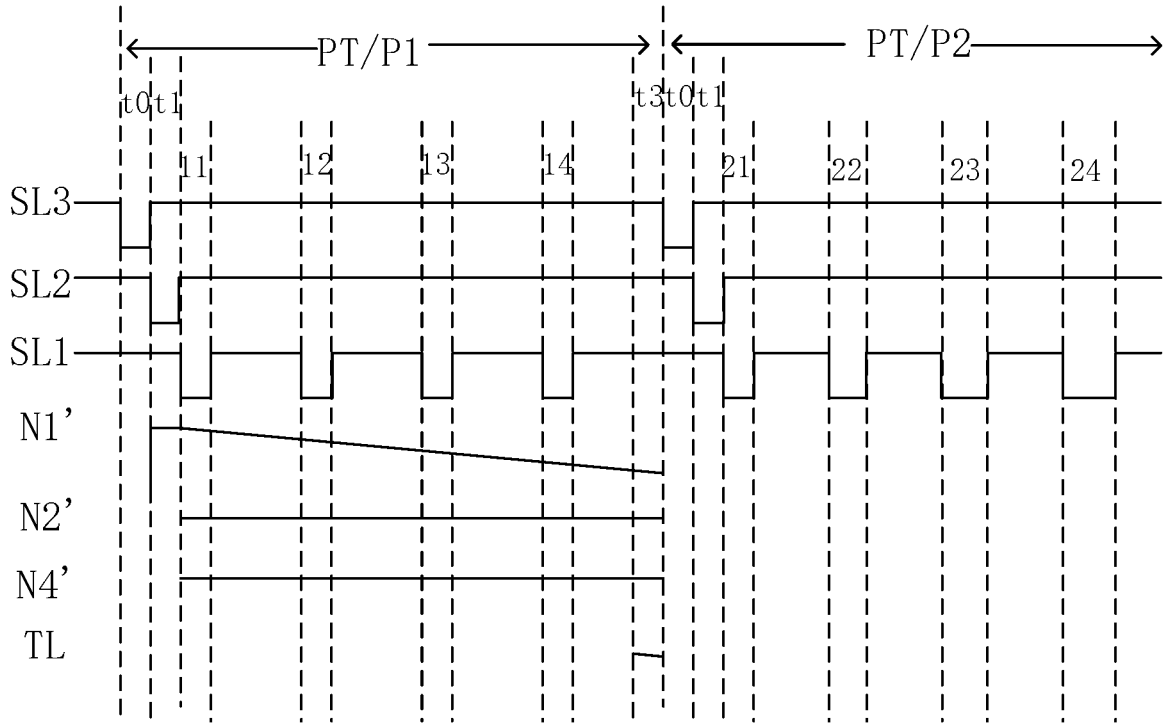
FIG. 6 is a time sequence diagram according to an embodiment of the present disclosure.
Figure 7:
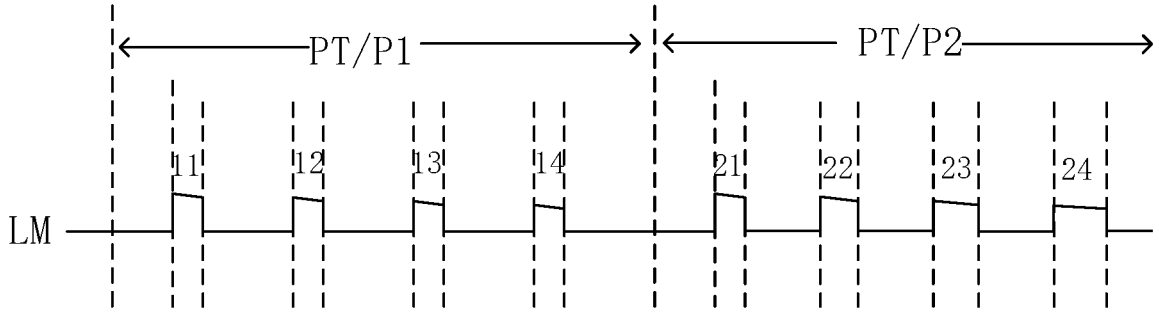
FIG. 7 is a schematic diagram of emission brightness corresponding to the time sequence shown in FIG. 6.

FIG. 6 is a time sequence diagram according to an embodiment of the present disclosure. FIG. 7 is a schematic diagram of emission brightness corresponding to the time sequence shown in FIG. 6

As shown in FIG. 6, in an embodiment of the present disclosure, the display panel can perform low frequency display. The low frequency display process includes a plurality of display periods PT, and each display period PT includes N frames of display sub-periods, where N is a positive integer larger than or equal to 2. It should be noted that the display sub-period for a row of pixels corresponds to the light-emitting stage of the pixel driving circuits PD of the row of pixels. In each frame of display sub-period of each display period PT, the respective rows of pixel driving circuits PD sequentially drive the corresponding light-emitting devices EL of the respective rows to emit light, with the light-emitting devices EL of each row emitting light simultaneously. For ease of understanding, FIG. 6 merely illustrates a time sequence diagram of one row of pixel driving circuits PD operating in the respective display sub-periods. As shown in FIG. 6, each display period PT includes four frames of display sub-periods, i.e., a first frame of display sub-period 11/21, a second frame of display sub-period 12/22, a third frame of display sub-period 13/23, and a fourth frame of display sub-period 14/24.

The display sub-period for the display panel shown in FIG. 6 corresponds to the light-emitting stage of the pixel driving circuit PD. As shown in FIG. 6, when one row of pixel driving circuits PD enters the light-emitting stage, the pixels corresponding to this row enters the display sub-period during the display process.

In addition, the display period PT further includes an initialization stage t0 and a data writing stage t1. During the display process, the initialization stage t0 for one row of pixels corresponds to the reset stage of the pixel driving circuits PD of this row of pixels, and the data writing stage t1 for one row of pixels corresponds to the data voltage writing stage of the pixel driving circuits PD of this row of pixels. In one display period PD for one row of pixels, the initialization stage t0 and the data writing stage t1 are operated prior to all the display sub-periods of the display period PD. Moreover, in one display period PD for one row of pixels, the initialization stage t0 and the data writing stage t1 are operated only once before the first frame of display sub-period 11/21 starts.

With reference to FIG. 3 and FIG. 6, in any display period PT for any row of pixels, first, the third scan line SL3 outputs an effective signal, such as a low-level signal, and the pixel driving circuit PD enters the reset stage, i.e., the display process enters the initialization stage t0 of the display period PT; then, the second scan line SL2 outputs an effective signal, such as a low-level signal, and the pixel driving circuit PD enters the data voltage writing stage, i.e., the display process enters the data writing stage t1 of the display period PT; next, the first scan line SL1 sequentially outputs an effective signal such as a low-level signal at a time interval, and the pixel driving circuit PD enters the reset stage repeatedly at a time interval, i.e., the display process enters the respective display sub-periods of the display period PT.

In one display period PT, the first scan line SL1 outputs an effective signal such as a low-level signal for a first time, and the pixel driving circuit PD enters the light-emitting stage, that is, the display process enters the first frame of display sub-period 11/21; then in the display period PT, the first scan line SL1 outputs an effective signal such as a low-level signal for a second time, and the pixel driving circuit PD enters the light-emitting stage, that is, the display process enters the second frame of display sub-period 12/22; then in the display period PT, the first scan line SL1 outputs an effective signal such as a low-level signal for a third time, and the pixel driving circuit PD enters the light-emitting stage, that is, the display process enters the third frame of display sub-period 13/23; next, in the display period PT, the first scan line SL1 outputs an effective signal such as a low-level signal for a fourth time, and the pixel driving circuit PD enters the light-emitting stage, that is, the display process enters the fourth frame of display sub-period 14/24. It should be noted that the above description is based on an example of one display period PT including four frames of display sub-periods. In actual applications, the first scan line SL1 can output the effective signal according to the actual number of display sub-periods included in the display period PT.

As shown in FIG. 6, in this embodiment of the present disclosure, the display periods PD for any row of pixels include at least one detection display period P1 and at least one compensation display period P2, the at least one detection display period P1 corresponding to the at least one compensation display period P2, and the detection period PT used as the detection display period P1 further includes a detection stage t3, which is operated after the display sub-periods.

As shown in FIG. 6, in the detection display period P1, the first detection node N1' in the voltage detection circuit TD receives, in the data voltage writing stage of the corresponding pixel driving circuit PD, i.e., in the data writing stage t1 of the detection display period P1, a potential that is the same as the potential of the first node N1 in the corresponding pixel driving circuit PD. In the detection display period P1, the second detection node N2', the third detection node N3' and/or the fourth detection node N4' in the voltage detection circuit TD receives, before or at the beginning of the first light-emitting stage of the detection display period P1, i.e., before or at the beginning of the first frame of display sub-period 11 of the detection display period P1, a potential that is the same as the potential of the second node N2, the third node N3 and/or the fourth node N4 in the corresponding pixel driving circuit PD. When the last frame of display sub-period of the detection display period P1 ends, the detection display period P1 enters the detection stage t3. In the detection stage t3, the detection signal line TL transmits the potential of the first detection node N1' to the signal processing module CD.

The signal processing module CD processes the received potential of the first detection node N1' transmitted by the detection signal line TL in the detection stage t3 and the potential of the first detection node N1' in the data writing stage t1/the data voltage writing stage, and determines the duration of each display sub-period for each row of pixels in the corresponding compensated display period P2 according to the processing result.

The potential of the first detection node N1' in the data writing stage t1 is substantially the same as the potential of the first node N1 in the data voltage writing stage, assuming that the potential of the first detection node N1' in the data writing stage t1 and the potential of the first node N1 in the data voltage writing stage are both V1; the potential of the first detection node N1' in the detection stage t3 is substantially the same as the potential of the first node N1 after the last light-emitting stage of a detection display period P1, assuming that the potential of the first detection node N1' in the detection stage t3 and the potential of the first node N1 after the last light-emitting stage of a detection display period P1 are both V2; and the potential of the third detection node N3' and the potential of the third node N3 are both V3. Then, in the detection display period P1, a change of the potential of each of the first detection node N1' and the first node N1 is $\Delta V=V2-V1$, the corresponding light-emitting driving current at the beginning of the first frame of display sub-period 11 is $I1=K(V3-V1)^2$, and the light-emitting driving current after the last frame of display sub-period (for example, the fourth display sub-period 14) ends is $I2=K(V3-V1-\Delta V)^2$, where K represents a current amplification factor of the light-emitting driving transistor T1. Then in the detection display period P1, a change of the light-emitting driving current in the pixel driving circuit PD is $\Delta I=I2-I1=K(V3-V1-\Delta V)^2-K(V3-V1)^2=K(\Delta V^2-2\Delta V(V3-V1))$, and correspondingly, a change rate of the light-emitting driving current is $A=\Delta I/I1=(\Delta V^2-2\Delta V(V3-V1))/(V3-V1)^2$. Since $\Delta V$ is relatively small relative to (V3−V1), correspondingly, then in the detection display period P1, the change rate A of the light-emitting driving current of the pixel driving circuit PD is substantially $A\approx|\Delta I/I1|=|-2\Delta V/(V3-V1)|$. Then in the detection display period P1, a change rate B of the brightness at the end of the last frame of display sub-period (for example, the fourth frame of display sub-period 14) relative to the brightness at the beginning of the first frame of display sub-period 11 is substantially the same as the change rate A of the light-emitting driving current, i.e., $B=A\approx|2\Delta V/(V3-V1)|$.

In an embodiment of the present disclosure, the voltage detection circuit TD can be used to determine the change rate of the light-emitting driving current of the pixel driving circuit in the detection display period P1, i.e., a change rate of brightness, and then the duration for compensating each display sub-period in the display period P2 can be extended according to the change rate of brightness, thereby completing brightness compensation in the compensation display period P2.

Then, the light-emitting duration of an N-th frame of display sub-period of the compensation display period P2 for any row of pixels can be adjusted to t0N, i.e., the duration for the first scan line SL1 transmitting the effective signal, so that the duration of an N-th light-emitting stage of the pixel driving circuit PD is adjusted to t0N. The light-emitting duration of the first frame of display sub-period is t01, i.e., the duration for the first scan line SL1 transmitting the effective signal, so that the duration of the first light-emitting stage of the pixel driving circuit PD is t01, where $(T0N-t01)/t01=B$, and $t0N-t01=B*t01=A*t01uit\Delta V/(V3-V1)|*t01$. That is, in the compensation display period P2, the duration of the N-th frame of display sub-period for any row of pixels increases by (A*t01) with respect to the duration of the first frame of display sub-period 21 of the row of pixels.

The potential of the first node N1 in the pixel driving circuit PD is not abruptly changed, but gradually changed. In an implementation manner of the present disclosure, as shown in FIG. 6, in the compensation display period P2, the duration of the display sub-period for any row of pixels gradually increases from the first frame of display sub-period to the N-th frame of display sub-period, that is, the duration for any row of pixel driving circuits PD gradually increases from the first light-emitting stage to the last light-emitting stage. As shown in FIG. 6, in the compensation display period P2, the duration for the first scan line SL1 outputting an effective signal in the second frame of display sub-period 22 is longer than the duration for the first scan line SL1 outputting an effective signal in the first frame of display sub-period 21, the duration for the first scan line SL1 outputting an effective signal in the third frame of display sub-period 23 is longer than the duration for the first scan line SL1 outputting an effective signal in the second frame of display sub-period 22, the duration for the first scan line SL1 outputting an effective signal in the fourth frame of display sub-period 24 is longer than the duration for the first scan line SL1 outputting an effective signal in the third frame of display sub-period 23.

As shown in FIG. 6, in the display sub-periods operated sequentially in a compensation display period P2, the duration for the first scan line SL1 transmitting an effective level signal (for example a low-level signal) gradually increases; correspondingly, as shown in FIG. 7, in the display sub-periods operated sequentially in a compensation display period P2, the duration of the specific emission brightness LM gradually increases.

Assuming that in the display period PT, the change in brightness is a linear change, then in an implementation manner of the present disclosure, as for two adjacent frames of display sub-periods of a compensation display period P2 for any row of pixels, the duration of a next frame of display sub-period is longer than the duration of a previous frame of display sub-period by A/(N−1)*t01, and in two adjacent display sub-periods of the compensation display period P2 for any row of pixels, an increase rate of the duration of a next frame of display sub-period relative to the duration of a previous frame of display sub-period is A/(N−1).

If $|\Delta V1=0.2V$, V3=4.6V, and V1=3.5V, then A=B≈36%. As shown in FIG. 6, assuming that the compensation display period P2 includes four frames of display sub-periods, then for two adjacent display sub-periods of the compensation display period P2 for any row of pixels, the duration of a next frame of display sub-period increases by 12% the duration of a previous frame of display sub-period.

In an implementation manner of the present disclosure, one detection display period P1 corresponds to a plurality of compensation display periods P2, that is, a plurality of compensation display periods P2 is operated after one detection display period P1, and among the plurality of compensation display periods P2, the duration of each display sub-period corresponding to any row of pixels is determined by the corresponding detection display period P1. The moment for starting the detection display period P1 may be determined autonomously by the display panel, for example, the moment for starting the detection display period P1 is a moment when monitoring that the display brightness is different from a predetermined value; or the moment for starting the detection display period P1 may be determined by the user according to the display effect of the display panel, for example, the moment for starting the detection display period P1 is a moment when the display has a flickering issue.

In an implementation manner of the present disclosure, in any two adjacent display periods PT among a plurality of display periods PT, a previous display period PT is the detection display period P1, and a next display period PT is the compensation display period P2. In other words, when brightness compensation is performed in one display period PT, the one display period PT also includes the detection stage t3, which provides a basis for the duration of brightness compensation for the next display period PT according to the above-mentioned manner. In this way, the brightness of the display panel can be compensated at all times.

Figure 8:
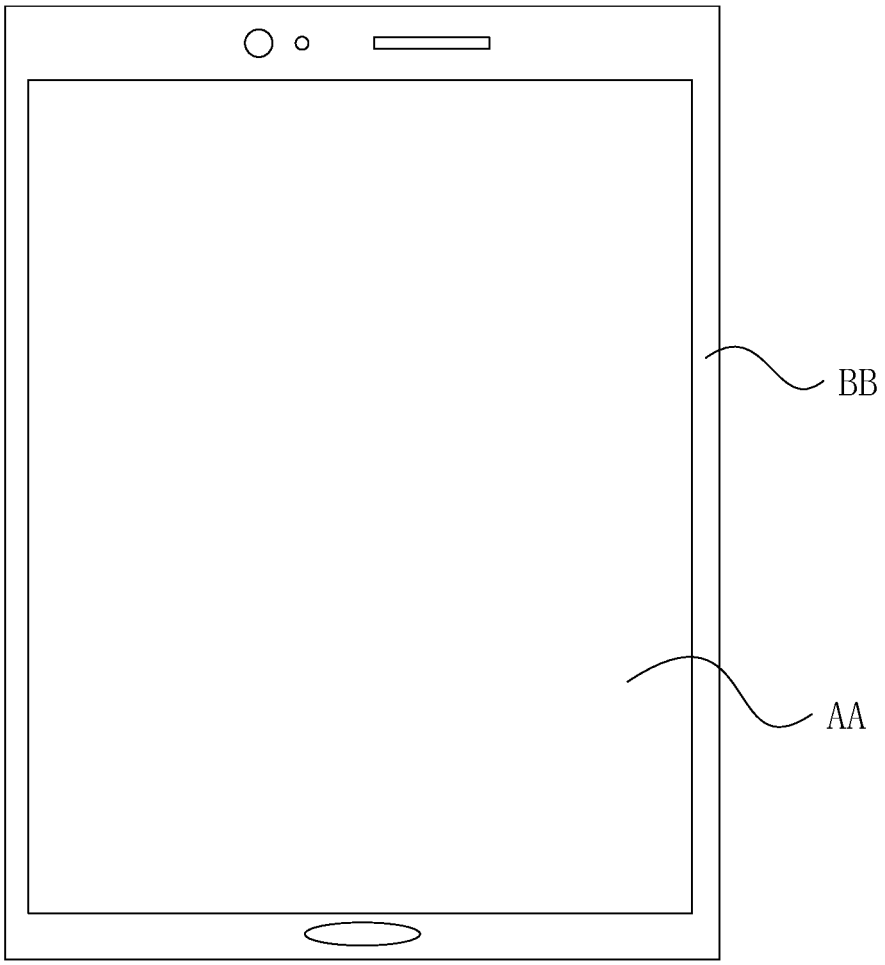
FIG. 8 is a schematic diagram of a display device according to an embodiment of the present disclosure.
Figure 9:
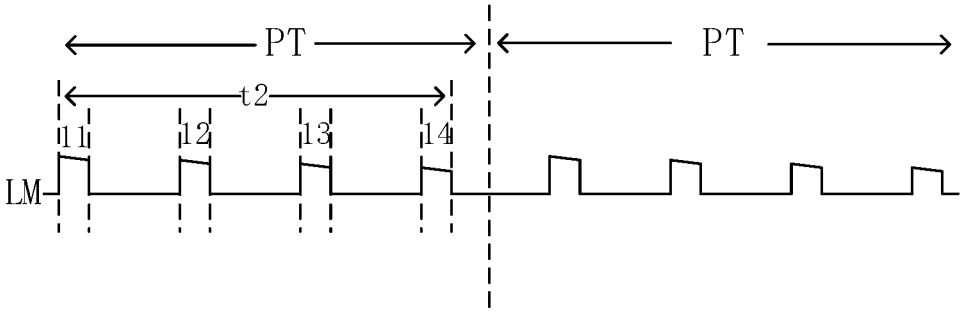
FIG. 9 (Prior Art)
FIG. 9 is a schematic diagram of emission brightness in the related art.

FIG. 8 is a schematic diagram of a display device according to an embodiment of the present disclosure. As shown in FIG. 8, the display device may be a mobile phone. In addition, the display device provided by the embodiments of the present disclosure may also be a display device such as a computer and a television. The display device provided by the embodiments of the present disclosure includes the display panel provided by any of the embodiments of the present disclosure. The display device includes a display area AA corresponding to the display panel and a non-display area BB disposed at a periphery of the display area AA.

In the display device provided by the embodiments of the present disclosure, the voltage detection circuit can detect the potential of gate electrodes of the light-emitting driving transistor in the pixel driving circuit, and then perform brightness compensation on the pixel driving circuit.

The above-described embodiments are merely preferred embodiments of the present disclosure and are not intended to limit the present disclosure. Various changes and modifications can be made to the present disclosure by those skilled in the art. Any modifications, equivalent substitutions and improvements made within the principle of the present disclosure shall fall into the protection scope of the present disclosure.

What is claimed is:

1. A display panel, comprising:

a plurality of pixel driving circuits, each pixel driving circuit comprising a light-emitting driving transistor, a first transistor, and a storage capacitor, wherein the light-emitting driving transistor comprises a first gate electrode, a first source electrode, and a first drain electrode; the first transistor comprises a second gate electrode, a second source electrode, and a second drain electrode; the storage capacitor comprises a first electrode plate and a second electrode plate; each of the first gate electrode, the second source electrode, and the second electrode plate is electrically connected to a first node; the second drain electrode is electrically connected to a second node; the first electrode plate is electrically connected to a third node; and the light-emitting driving transistor is configured to generate a light-emitting driving current and output the light-emitting driving current through the first drain electrode in a light-emitting stage;

at least one voltage detection circuit, each voltage detection circuit corresponding to at least one pixel driving circuit of the plurality of pixel driving circuits and comprising a detection capacitor, a first detection transistor, and a detection signal line, wherein the first detection transistor comprises a third source electrode and a third drain electrode; the detection capacitor comprises a third electrode plate and a fourth electrode plate; the third source electrode, the fourth electrode plate and an end of the detection signal line are electrically connected to a first detection node, the third drain electrode is electrically connected to a second detection node, and the third electrode plate is electrically connected to a third detection node; and a signal processing module, wherein before the light-emitting stage of the plurality of pixel driving circuits starts, a potential of the first detection node of each of the at least one voltage detection circuit is the same as a potential of the first node in each of the at least one pixel driving circuit of the plurality of pixel driving circuits corresponding to the voltage detection circuit; in the light-emitting stage, a potential of the third detection node of the voltage detection circuit is the same as a potential of the third node in each of the at least one pixel driving circuit corresponding to the voltage detection circuit, and a potential of the second detection node of the voltage detection circuit is the same as a potential of the second node in each of the at least one pixel driving circuit corresponding to the voltage detection circuit; and in the light-emitting stage, the third gate electrode controls the first detection transistor to be turned off, and the second gate electrode controls the first transistor to be turned off; and in a detection stage, the detection signal line of the voltage detection circuit outputs the potential of the first detection node to the signal processing module, wherein the first detection transistor and the first transistor are structured the same.

2. The display panel according to claim 1, wherein the second node in each of the plurality of pixel driving circuits is electrically connected to a data voltage signal line, a reset signal line, or the first drain electrode.

3. The display panel according to claim 1, wherein each of the plurality of pixel driving circuits further comprises a second transistor, wherein the second transistor comprises a fourth gate electrode, a fourth source electrode, and a fourth drain electrode, the fourth source electrode is electrically connected to the first node, and the fourth drain electrode is electrically connected to a fourth node;

wherein each of the at least one voltage detection circuit further comprises a second detection transistor, wherein the second detection transistor comprises a fifth gate electrode, a fifth source electrode, and a fifth drain electrode, wherein the fifth source electrode is electrically connected to the first detection node, the fifth drain electrode is electrically connected to a fourth detection node, and the second detection transistor and the second transistor are structured the same; and wherein in the light-emitting stage, a potential of the fourth detection node of the voltage detection circuit is the same as a potential of the fourth node in each of the at least one pixel driving circuit corresponding to the voltage detection circuit, the fourth gate electrode controls the second transistor to be turned off, and the fifth gate electrode controls the second detection transistor to be turned off.

4. The display panel according to claim 3, wherein the fourth node in the pixel driving circuit is electrically connected to a data voltage signal line, a reset signal line, or the first drain electrode; and a signal terminal connected to the fourth node is different from a signal terminal connected to the second node.

5. The display panel according to claim 1, wherein a potential of the first detection node before the light-emitting stage is written by the detection signal line.

6. The display panel according to claim 1, wherein a potential of the first detection node before the light-emitting stage is written by the first detection transistor that is turned on.

7. The display panel according to claim 1, wherein a potential of each detection node in the voltage detection circuit is acquired from the signal processing module.

8. The display panel according to claim 7, wherein the at least one voltage detection circuit is a plurality of voltage detection circuits, and the plurality of voltage detection circuits is connected in parallel.

9. The display panel according to claim 3, wherein the plurality of pixel driving circuits comprise a plurality of first pixel driving circuits and at least one second pixel driving circuit; each of the plurality of first pixel driving circuits is connected to a light-emitting device and configured to provide the light-emitting driving current for the light-emitting device; and the at least one second pixel driving circuit is not electrically connected to a light-emitting device, wherein the second detection node and the third detection node in each voltage detection circuit of the at least one voltage detection circuit are electrically connected to the second node and the third node in one second pixel driving circuit of the at least one second pixel driving circuit, respectively.

10. The display panel according to claim 9, wherein pixel driving circuits of each row of the plurality of pixel driving circuits comprise first pixel driving circuits and a second pixel driving circuit at a side of the first pixel driving circuits close to a non-display area, and one of the at least one voltage detection circuit electrically connected to the second pixel driving circuit is provided at a side of the second pixel driving circuit close to the non-display area.

11. A display device, comprising the display panel according to claim 1.

12. A brightness compensation method for performing brightness compensation on the display panel according to claim 1, wherein a low frequency display process of the display panel comprises a plurality of display periods, each of the plurality of display periods comprises a data writing stage and N frames of display sub-periods, and the data voltage writing stage is operated before the N frames of display sub-periods; each frame of display sub-period of the N frames of display sub-periods for one row of pixels corresponds to the light-emitting stage of pixel driving circuits of the row of pixels, and the data writing stage for the row of pixels corresponds to a data voltage writing stage of the pixel driving circuits of the row of pixels, where N is a positive integer greater than or equal to 2;

wherein the plurality of display periods comprises at least one detection display period and at least one compensation display period corresponding to the at least one detection display period, each of the at least one detection display period further comprises a detection stage, and the detection stage is operated after the plurality of display sub-periods, wherein the brightness compensation method comprises:

in the detection stage of each of the at least one detection display period, transmitting, by the detection signal line, the potential of the first detection node to the signal processing module;

processing, by the signal processing module, the received potential of the first detection node and a potential of the first detection node in the data writing stage; and determining a duration of each frame of display sub-period of the N frames of display sub-periods during a corresponding one of the at least one compensation display period for each row of pixels according to a processing result.

13. The brightness compensation method according to claim 12, wherein during the compensation display period, the duration gradually increases from a first frame of display sub-period to an N-th frame of display sub-period for any row of pixels.

14. The brightness compensation method according to claim 13, wherein processing, by the signal processing module, the received potential of the first detection node and the potential of the first detection node in the data writing stage comprises: determining a change rate of the light-emitting driving current corresponding to each of the at least one detection display period, wherein the change rate is A; and determining a duration of each frame of display sub-period of the N frames of display sub-periods during a corresponding one of the at least one compensation display period for each row of pixels according to a processing result comprises: for two adjacent frames of display sub-periods of each of the at least one compensation display period for any row of pixels, increasing a duration of a next frame of display sub-period by A/(N−1) the duration of a previous frame of display sub-period.

15. The brightness compensation method according to claim 12, wherein one detection display period corresponds to a plurality of compensation display periods, and a duration of the light-emitting stage of each frame of display sub-period in each of the plurality of compensation display periods is determined by the detection display period.

16. The brightness compensation method according to claim 12, wherein in any two adjacent display periods of the plurality of display periods, a previous display period is a detection display period, and a next display period is a compensation display period.

* * * * *